United States Patent [19]

Osborne et al.

[11] 4,455,919

[45] Jun. 26, 1984

[54] LAST SHOT BOLT HOLD-OPEN DEVICE

[75] Inventors: William E. Osborne, Guilford; Nicholas A. Ketre, Clinton, both of Conn.

[73] Assignee: The Marlin Firearms Company, North Haven, Conn.

[21] Appl. No.: 374,033

[22] Filed: May 3, 1982

[51] Int. Cl.[3] ..... F41D 9/00

[52] U.S. Cl. ..... 89/138

[58] Field of Search ..... 89/138; 42/17, 21

[56] References Cited

U.S. PATENT DOCUMENTS

| | | | |
|---|---|---|---|
| 659,507 | 10/1900 | Browning | 89/138 |
| 874,856 | 12/1907 | Mason | 89/138 |
| 3,570,366 | 3/1971 | Nickel | 89/138 |
| 3,688,640 | 9/1972 | Seecamp | 89/138 |

*Primary Examiner*—Donald G. Kelly

*Attorney, Agent, or Firm*—Walter Spruegel

[57] ABSTRACT

Action disabling device in a firearm having among its conventional components a spring-closed breech bolt, a tubular magazine, and a pivoted cartridge lifter. The disabling device is in the form of an operating arm pivoted with one end to a fixed part of the action so as to be swingable with its other end into active and inactive positions in which the same is in and out, respectively, of the closing path of the breech bolt, and is normally spring-urged into its inactive position, with this operating arm being, on overtravel of the lifter in lift direction for lack of a cartridge thereon, engaged and taken along by the lifter into its active position to stop the breech bolt on partial closure of the same. The operating arm is one of the arms of a double-arm lever the other arm of which projects to the outside of the receiver and is there accessible to an operator's finger for swinging the operating arm to its inactive position.

4 Claims, 4 Drawing Figures

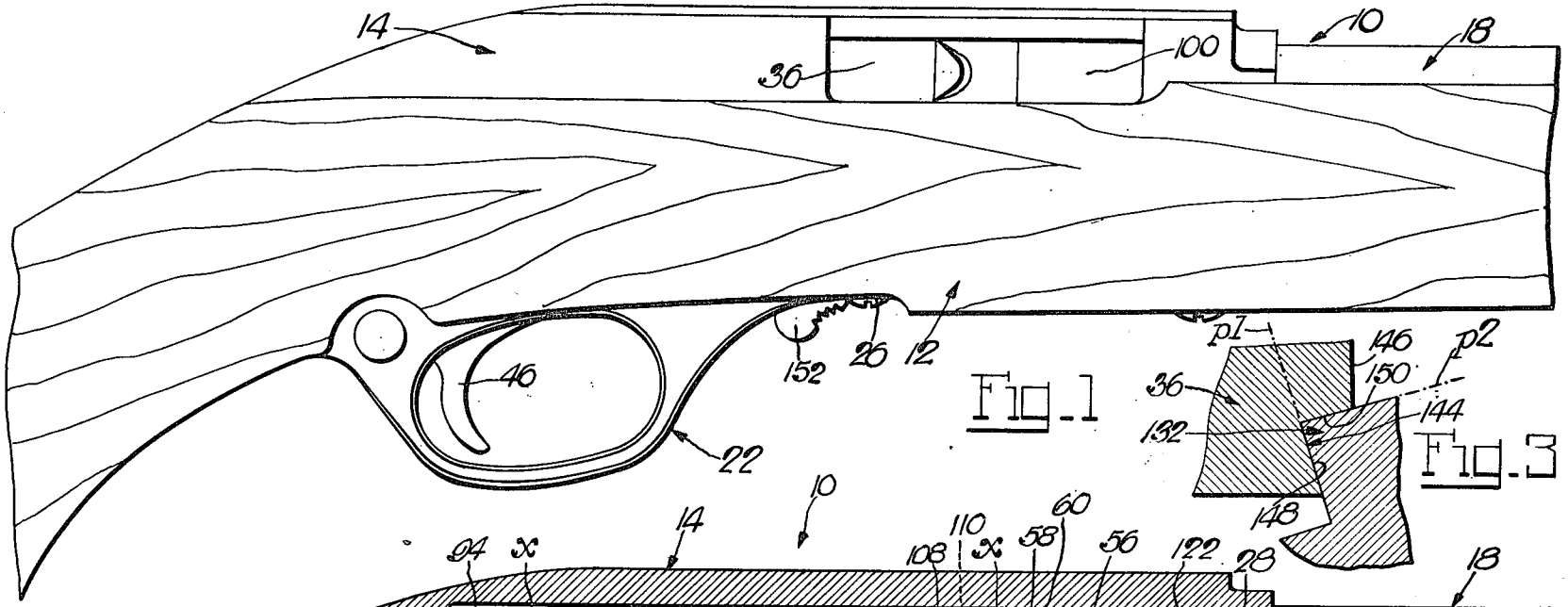
FIG. 1
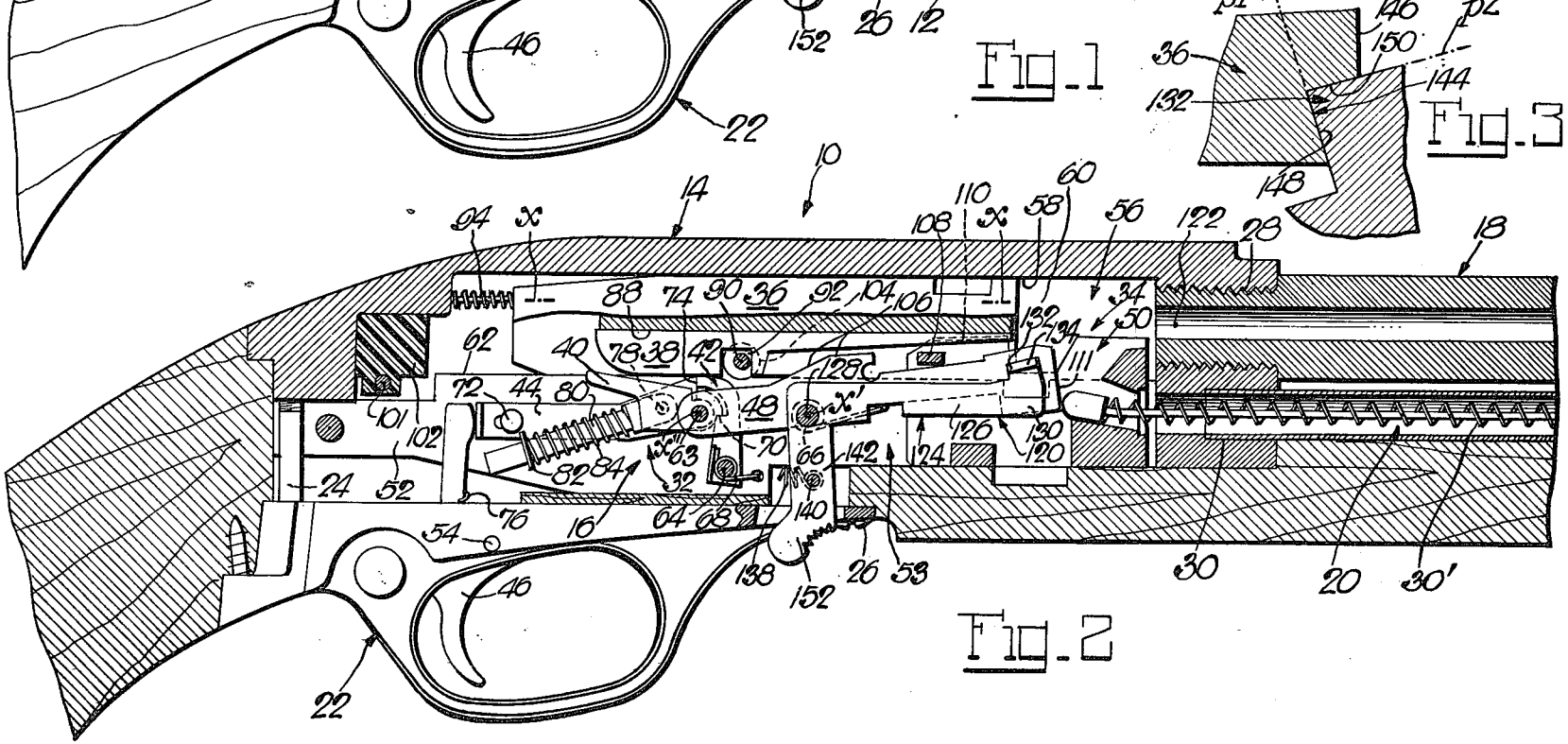
FIG. 2
FIG. 3

LAST SHOT BOLT HOLD-OPEN DEVICE

This invention relates in general to repeater-type firearms of automatic breech bolt operation, and more particularly to action disabling devices for firearms of this type responding to cartridge feed interruption from the magazine of tubular type to the action from any cause.

It is a primary object of the present invention to provide in a firearm of this type an action disabling device which is not only of exceedingly simple structure and of particularly low cost, but is also entirely reliable in its performance notwithstanding the severe and abrupt forces to which actions of such firearms are subjected in firing.

It is another important object of the present invention to provide in a firearm of this type an action disabling device in the simple form of an operating arm which requires for its mount in the action a mere pivot support and a simple spring for its operation, with the arm being swingable into active and inactive positions in and out, respectively, of the closing path of the breech bolt, and being normally urged into its inactive position by the spring, and the cartridge lifter has a finger which, on overtravel of the lifter in lift direction for lack of a cartridge thereon, engages the operating arm in its inactive position and takes the same along to its active position to stop the breech bolt on partial closure of the same.

It is a further object of the present invention to provide in a firearm of this type an action disabling device of which the axis of the pivot support for the aforementioned operating arm is parallel to the pivot axis of the cartridge lifter and located rearwardly of the lifting forward end of the latter, and the operating arm extends forwardly from its pivot support and has at its forward end a raised shoulder which in the active arm position is in the path of a companion shoulder on the breech bolt on its closure, whereby on impact of the shoulder on the closing breech bolt with the shoulder on the operating arm in its active position the latter will be subjected to tension and, hence, will safely absorb the considerable impact load of the breech bolt.

It is another object of the present invention to provide in a firearm of this type an action disabling device of which the aforementioned finger on the cartridge lifter is advantageously formed by the bent end of the conventional helical lifter spring which extends beneath the lifter and beneath the operating arm as well. With this arrangement, the lifter spring which is calibrated for reliable performance of the cartridge lifter in the characteristic lively fashion, makes for equally reliable and lively performance of the operating arm pursuant to cartridge feed interruption to the action from any cause.

A further object of the present invention is to provide in a firearm of this type an action disabling device of which the aforementioned companion shoulders on the breech bolt and operating arm are formed so that on impact of the shoulder on the closing breech bolt with the shoulder on the operating arm in its active position both shoulders will reliably interlock against disengagement under momentary operational shock with a force which even increases with the impact force. To this end, the shoulder on the breech bolt is formed by a preferably machined notch in its front face the sides of which lie in planes approximately normal to each other, with the "impact" side of the notch facing forwardly and being undercut, and the other side of the notch overhanging the impact side, and the shoulder on the operating arm is in the form of a lug which is shaped to be in substantial form-fit with the sides of the notch in the breech bolt when in engagement therewith. Thus, the impact side of the notch will on impact with the lug on the operating arm forcefully cam the lug upwardly against the other side of the notch and thereby firmly interlock the operating arm and breech bolt in partially closed position of the latter, with this interlock being all the more secure by the considerable forces of the bolt spring and lifter spring.

Another object of the present invention is to provide in a firearm of this type an action disabling device of which the aforementioned operating arm is one arm of a double-arm lever the other arm of which extends to the outside of the receiver for access by an operator's finger for the purpose of rocking the operating arm from interlock with the breech bolt for spring-return to its inactive position and thereby restore the action after reloading the magazine with cartridges or repair a cartridge jam in the magazine, whichever caused the cartridge feed interruption.

Further objects and advantages will appear to those skilled in the art from the following, considered in conjunction with the accompanying drawings.

In the accompanying drawings, in which certain modes of carrying out the present invention are shown for illustrative purposes:

FIG. 1 is a fragmentary side view of a firearm embodying the invention;

FIG. 2 is a fragmentary longitudinal section through the same firearm;

FIG. 3 is an enlarged fragmentary section through the firearm.

Figure 2A:
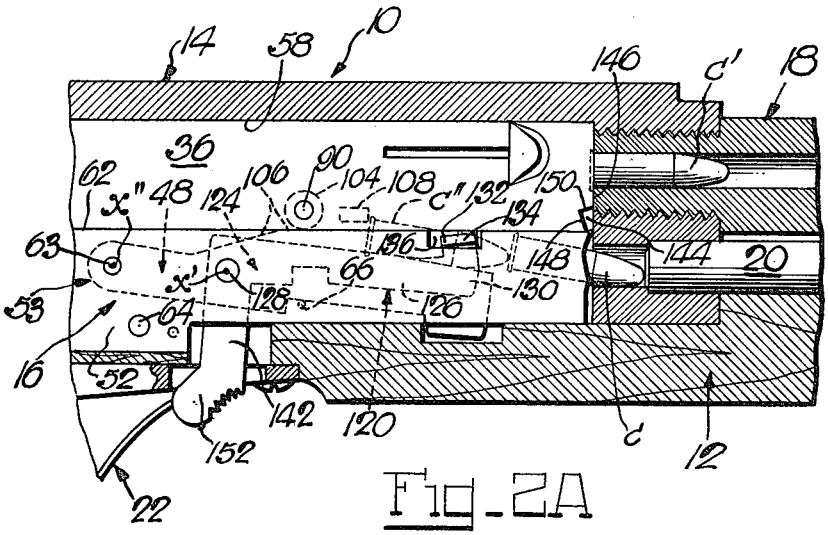
FIG. 2A is a fragmentary longitudinal section through the firearm similar to that of FIG. 2 but showing the action in a different operating position.

Referring to the drawings, the reference numeral 10 designates a repeater firearm having as its major components a stock 12, a receiver 14 with an action 16 therein, a barrel 18, a tube-type magazine 20, and a trigger guard 22. The receiver 14 and trigger guard 22 are suitably mounted in the stock 12 by screws 24 and 26, and the barrel 18 and magazine 20 are at 28 and 30 mounted in the forward end of the receiver 14. The magazine 20 has the usual spring 30' for the feed of cartridges c to the action 16 (FIG. 2A).

The action 16 has as its major operating components a firing mechanism 32 and a cartridge transfer device 34. The firing mechanism 32 provides a breech bolt 36 with a firing pin 38, a hammer 40, a sear 42, a link 44 and a trigger 46, while the transfer device 34 provides a cartridge lifter 48 and a feed throat 50. All of these parts, except the trigger 46 and the breech bolt 36 with its firing pin 38, are in this instance mounted on and between spaced side plates 52 and form therewith a preferred preassembled unit 53, while the trigger 46 is at 54 pivoted in the guard 22, and the breech bolt 36 is received for movement in the direction of its axis x in a guideway 56 which is formed in the receiver 14 by the top and opposite side walls 58 and 60 thereof and by the top surfaces 62 of the side plates 52. The hammer 40 and lifter 48 are pivoted on a common crosspin 63 between the side plates 52, and the sear 42 is pivoted on another crosspin 64 between these plates, with the lifter 48 being normally urged by a spring 66 in lift direction, and the sear 42 being normally urged by a spring 68 into the position in FIG. 2 in which it is with its nose 70 in interlock with a shoulder on the hammer 40 and holds the latter in its cocked position. The link 44 is mounted for limited longitudinal movement on the crosspin 63 and on a stud 72 on one of the side plates 52, and the same has at its forward end a shoulder 74 which cooperates with a similar shoulder on the sear 42 to retract the latter from interlock with the cocked hammer 40 on pulling the trigger 46 against the force of its return spring 76. Pivotally connected at 78 with the hammer 40 is a link 80 which extends through and is slidable in a pivoted seat 82 for a preloaded spring 84 which surrounds the link and through the latter forces the hammer into striking engagement with the firing pin in the bolt 36, when closed, for firing the chambered cartridge c' (FIG. 2A) when on the pull of the trigger the cocked hammer is released from the sear. The feed throat part 50 is also suitably mounted between the side plates 52, and the preassembled unit 53 is, in turn, suitably mounted with its side plates 52 in the receiver 14.

The firing pin 38 is slidably received in a guide groove 88 in the breech bolt 36, and is held therein for limited operational movement by a crosspin 90 in the bolt which extends through an elongated notch 92 in the firing pin. The breech bolt 36 is normally urged into closed position by a spring 94, and the same carries at its forward end the usual extractors (not shown). The receiver 14 is provided with the usual side port 100 through which an extracted cartridge shell is ejected on rearward excursion of the breech bolt following the firing of the cartridge. Rearward excursion of the breech bolt 36 is responsive to firing a cartridge, the bolt being in this instance blown rearwardly by the powder gases of the fired cartridge. Mounted at 101 in the receiver 14 is a pad 102 of non-metallic material, such as nylon, against which the blown-back breech bolt 36 impacts with minimum noise.

The firearm described so far may be entirely conventional and forms no part of the present invention except insofar as it enters into combination therewith. In its operation, when the firearm is in condition ready for firing (FIG. 2A), the breech bolt 36 is in closed position in which a roller 104 on the crosspin 90 cooperates with the cam formation 106 on the lifter 48 to hold the latter in its depressed position in which it is in lift relation with the last admitted cartridge in the feed throat 50. This latter cartridge is by the following spring-urged cartridges c in the magazine 20 urged against a stop lug 108 in the throat 50 and thus stops the feed of an additional cartridge or cartridges from the magazine into the throat. On pulling the trigger 46, the chambered cartridge c' will be fired, whereupon the breech bolt 36 will by the powder gases be blown rearwardly against the force of the spring 94 and will on impact with the pad 102 be immediately returned to its closed position by the spring 94. During its rearward excursion in this manner, the breech bolt 36 will cam the hammer 40 into the depressed, cocked, position in FIG. 2 in which it will be locked by the sear 42, and the roller 104 on the breech bolt will cooperate with the cam formation 106 on the lifter 48 to permit spring-urged up-swing of the latter during which it carries the cartridge thereon to the top of the feed throat 50 until stopped when this cartridge reaches the usual top lip 110 on the throat at which the cartridge is held in chambering relation with the retracted breech bolt. During such up-swing of the lifter 48 a front shoulder 111 thereof holds the nearest cartridge from entering the throat 50. On the succeeding spring-urged excursion of the breech bolt 36 into its closed position, the same will chamber the cartridge in its path in usual manner and also operate the lifter 48 into its depressed position to admit the next cartridge into the throat 50 and also into lift relation with the lifter, whereupon the firearm is again ready for firing, as will be readily understood.

In accordance with the present invention, there is provided in the firearm a device 120 which will disable the action on cartridge feed interruption to the feed throat from any cause. More particularly, the device will on such cartridge feed interruption hold the breech bolt in the partly open position in FIG. 2 and thus not only disable the action but also indicate quite unmistakably the absence of a cartridge in the feed throat and, hence, also in the firing chamber 122. Thus, while the breech bolt in its partially open position calls for reloading of the magazine with cartridges or for repairing some malfunction of the cartridge feed, such as a possible cartridge jam in the magazine, the important safety aspect of the device is full expectation by anyone that the firearm is ready for firing whenever the breech bolt is observed to be closed and, hence, must be handled with appropriate care in any event, i.e., whether the firearm is actually ready for firing, or whether no cartridge is chambered but the device has previously been manipulated to restore the action by permitting the breech bolt to close in a manner to be explained. The device is in the form of a lever 124 having an operating arm 126, with this lever being mounted in the action 16 for rocking movement about a pivot 128 the axis x' of which extends parallel to the pivot axis x'' of the cartridge lifter 48 so that the latter and the lever 124 are swingable in parallel planes. The pivot 128 for the support of the lever 124 is secured to, and extends inwardly from, one of the opposite side plates 52 of the unit 53 (FIG. 2A). The forward end 130 of the operating arm 126 has a raised lug 132 with a side tab 134 which in an "inactive" position of the operating arm (FIG. 2A) rests against the bottom of a groove 136 in the top of the side plate 52 which is shown in FIG. 2A, with the operating arm 126 being normally urged into this inactive position by a spring 138 which is suitably anchored with one end in the unit 53 and with its other end to a pin 140 on another arm 142 of the lever 124 (FIG. 2). The operating arm 126 is shown in FIG. 2 in an "active" position in which its raised lug 132 is in the path of the breech bolt 36 on its closure, and more particularly in the path of a notch 144 in the front face 146 of the bolt. The notch 144 has two sides 148 and 150 which lie in planes p1 and p2 that extend substantially normal to each other (FIG. 3), with the "impact" side 148 being undercut, and the other side 150 overhanging the impact side 148. The lug 132 on the operating arm 126 is shaped so as to be in substantial form-fit with the notch 144 in the bolt 36 when in engagement therewith (FIG. 3).

Assuming now that the last cartridge from the magazine 20 has just been fired, the disabling device 120 will then go into action and stop the breech bolt 36 in its partly open position (FIG. 2) on its closing movement immediately following its rearward excursion pursuant to firing this last cartridge. Thus, with no cartridge being then on the lifter 48, the latter will on such rearward excursion of the breech bolt overtravel until stopped by the lug 108 in the throat 50, and the operating arm 126 will be compelled by the lifter spring 66 to follow the overtraveling lifter 48 to its active position in FIG. 2 in which its raised lug 132 is in the path of the notch 144 in the breech bolt 36 ready for impact with the notch 144 on spring-closure of the breech bolt to its partially open position in FIG. 2. In thus impacting, the notch 144 in the breech bolt and the lug 132 on the operating arm will come into interlock which is particularly firm owing to the interwedging action of the notch and lug and the considerable forces of the bolt spring 94 and lifter spring 66, as will be readily understood. The action is thus disabled, and this is clearly demonstrated to any observer by the breech bolt in its "abnormal" partially open position which unmistakably calls for restoration of the action for any further use of the firearm by restoring the cartridge feed to the feed throat 50, either by reloading the empty magazine with fresh cartridges or by repairing a cartridge jam in the magazine, whichever caused the cartridge feed interruption. Having once restored the cartridge feed to the feed throat, the operating arm will have to be returned to its inactive position for restoring the action. To the latter end, an operator will use a finger in pulling the exposed trigger-like end 152 of the other arm 142 of the lever 124 with sufficient force to rock the latter with its lug 132 from interlock with the notch 144 in the breech bolt 36 whereupon the lever 124 will be spring-returned to its inactive position (FIG. 2A) and the breech bolt will finish its forward excursion to closed position. However, in order fully to restore the action to the extent of delivering a fresh cartridge from the magazine 20 to the firing chamber 122, the breech bolt will have to be manually opened and closed once in order to deliver such cartridge to the firing chamber via the throat 50, lifter 48 and breech bolt 36, as will be readily understood.

We claim:

1. In a firearm, the combination with an action having a spring-closed breech bolt reciprocable in the direction of its longitudinal axis, a magazine tube with a cartridge feed spring, a feed throat, a cartridge lifter mounted for pivoting about a fixed axis normal to the longitudinal bolt axis and being urged in lift direction by a lifter spring, with said lifter being bolt-operated into depressed position, and overtraveling in lift direction on cartridge feed interruption to said throat, of an action disabling device providing an operating arm mounted with one end in the action for pivoting about a fixed axis parallel to the pivot axis of the lifter into active and inactive positions in which its other end is in and out, respectively, of the path of the bolt in closing direction, a spring urging said arm into its inactive position, and a finger on the lifter engaging said arm in its inactive position remote from its pivot axis and swinging it to its active position on said overtravel of the lifter to stop the breech bolt in partially closed position, with the bolt being released for full closure on rocking said arm to its inactive position.

2. The combination in a firearm as in claim 1, in which said pivot axis of said operating arm is located rearwardly of the lifting end of the lifter and said other end of said operating arm is spaced forwardly from said one end thereof, and said lifter spring is of helical type and has an end extending underneath the lifter remote from its pivot axis for urging it in lift direction, with said spring end extending also underneath said operating arm remote from its pivot axis and constituting said finger.

3. The combination in a firearm as in claim 2, in which said bolt has a front face, and said operating arm and bolt have first and second shoulders, respectively, of which said first shoulder is in said active position of said arm in the path of said second shoulder on bolt closure, said second shoulder is formed by a notch in said bolt face the sides of which lie in planes substantially normal to each other, with one of said sides facing forwardly and being undercut and the other side overhanging said one side, and said first shoulder is formed by a raised lug on said other end of said arm, with said lug being shaped to be in substantial form-fit with said notch when in engagement therewith, whereby said operating arm and bolt are firmly interlocked in said partially closed position of the latter.

4. The combination in a firearm as in claim 3, which further provides a receiver in which the action is mounted, and said operating arm is one arm of a double-arm lever the other arm of which projects to the outside of the receiver to be accessible to an operator's finger for rocking said operating arm from interlock with said bolt for spring-return to its inactive position.

* * * * *